US006051966A

United States Patent [19]

Pontarollo

[11] Patent Number: 6,051,966

[45] Date of Patent: Apr. 18, 2000

[54] BIAS SOURCE INDEPENDENT FROM ITS SUPPLY VOLTAGE

[75] Inventor: Serge Pontarollo, Saint Martin le Vinoux, France

[73] Assignee: STMicroelectronics S.A., Gentilly, France

[21] Appl. No.: 09/160,425

[22] Filed: Sep. 25, 1998

[30] Foreign Application Priority Data

Sep. 30, 1997 [FR] France ..... 97 12389

[51] Int. Cl.[7] ..... G05F 3/20

[52] U.S. Cl. ..... 323/315; 323/312

[58] Field of Search ..... 323/312, 313, 323/314, 315; 330/257, 288; 327/538, 539

[56] References Cited

U.S. PATENT DOCUMENTS

| | | | |
|---|---|---|---|
| 4,414,502 | 11/1983 | Wong | 323/315 |
| 4,461,991 | 7/1984 | Smith | 323/312 |
| 4,507,573 | 3/1985 | Nagano | 307/297 |
| 4,603,290 | 7/1986 | Shinomiya | 323/315 |
| 5,512,816 | 4/1996 | Lambert | 323/315 |
| 5,625,281 | 4/1997 | Lambert | 323/315 |
| 5,684,393 | 11/1997 | Ryat | 323/312 |

OTHER PUBLICATIONS

French Search Report from French Patent Application 97 12389, filed Sep. 30, 1997.

Hart, B.: "Temperature–Insensitive Voltage Divider", Elektor Electronics, vol. 19, No. 210, Apr. 1, 1993, pp 52–53.

*Primary Examiner*—Matthew Nguyen

*Attorney, Agent, or Firm*—Wolf, Greenfield & Sacks, P.C.; James H. Morris; Theodore E. Galanthay

[57] ABSTRACT

The present invention relates to a Vbe/R bias source of the type including a first reference branch, a second output branch, and means of correction of an output current by an error current proportional to the current flowing in the reference branch.

8 Claims, 2 Drawing Sheets

BIAS SOURCE INDEPENDENT FROM ITS SUPPLY VOLTAGE

BACKGROUND OF THE INVENTION

1. Field of the Invention

The present invention relates to the field of bias sources adapted to set a biasing current to a predetermined value, this current then being replicated to supply different sub-assemblies of an electronic circuit. The present invention more specifically relates to bias sources implemented by means of bipolar transistors.

2. Discussion of the Related Art

FIG. 1 shows an example of conventional diagram of a Vbe/R bias source. Such a bias source includes a first reference branch, formed of a resistor R connected in series with a bipolar transistor T1 between two supply lines Vcc and Vee, and a second output branch, formed of a bipolar transistor T2 connected in series with a resistor $R_{pol}$ between one of the supply lines and an output terminal 1 of the bias source. In the example shown in FIG. 1, the bias source is a current sink and transistors T1 and T2 are NPN transistors. The collector of transistor T1 is connected to line Vcc (of positive supply) via resistor R of biasing of the assembly and the emitter of transistor T1 is connected to line Vee (generally, the ground). The base of transistor T1 is connected to the emitter of transistor T2, the collector of which forms output terminal 1. The base of transistor T2 is connected to the collector of transistor T1. The emitter of transistor T2 is connected to line Vee via resistor $R_{pol}$ meant to set the value of current $I_{out}$ generated by the bias source. The reproduction of current $I_{out}$ or of its multiple, to bias different sub-assemblies of the circuit associated with the bias source shown in FIG. 1, is performed by means of transistors connected as a current mirror between terminal 1 and supply line Vcc. A first PNP-type bipolar transistor Q is diode-mounted between supply line Vcc and terminal 1, and other bipolar transistors Q' are connected as current mirrors on this transistor Q. The number of transistors Q' depends on the number of sub-assemblies to be biased and the respective surface ratios between a transistor Q' and transistor Q set the proportionality ratio between current $I_{out}$ and the biasing current of the corresponding sub-assembly. In FIG. 1, transistors Q and Q' have been shown in dotted lines, since they do not belong to the actual bias source.

A disadvantage of such a bias source is that current $I_{out}$ depends on the value of supply voltage Vcc.

To evaluate the dependence of the output current with respect to the supply voltage, parameter S which, by definition, represents the variation percentage of a current divided by the variation percentage of a voltage, or conversely, can be used.

Thus, parameter $S_{V_{cc}}^{I_{out}}$ represents the variation percentage of the output current ($dI_{out}/I_{out}$) divided by the variation percentage of the supply voltage ($dV_{cc}/V_c c$).

Among the equations governing the assembly of FIG. 1, neglecting the base currents of the transistors, one can write:

$$I_{out} = Ie_2 = \frac{Vbe_1}{R_{pol}} = \frac{Vt}{R_{pol}} \cdot \mathrm{Ln}\frac{I_{ref}}{Is_1},$$

where $Ie_2$ represents the emitter current of transistor T2, Vt represents the thermodynamic voltage, $Is_1$ represents the saturation current of transistor T1 which depends on technological parameters (base doping, base width, etc.) and on the emitter surface and is independent from the supply voltage, and Iref is the reference current flowing through resistor R.

By differentiating this formula with respect to Vcc, parameter S can be expressed as follows:

$$S_{V_{cc}}^{I_{out}} = \frac{Vt}{R_{pol} \cdot I_{out}} \cdot S_{V_{cc}}^{I_{ref}},$$

where $S_{V_{cc}}^{I_{out}}$ represents the variation percentage of current $I_{ref}$ divided by the variation percentage of supply voltage Vcc.

Now, for a sufficiently high supply voltage Vcc (for example, approximately 10 volts), parameter $S_{V_{cc}}^{I_{ref}}$ can be considered to be equal to 1. Indeed, $I_{ref}$=(Vcc−$Vbe_1$−$Vbe_2$)/R, where $Vbe_2$ represents the base-emitter voltage of transistor T2, and the base-emitter voltage drops can then be neglected with respect to the supply voltage. Conversely, the presence of a term in $1/I_{out}$ in parameter $S_{V_{cc}}^{I_{out}}$ while all other terms (Vt, $R_{pol}$, and $S_{V_{cc}}^{I_{ref}}$ are constant clearly shows the dependence of the output current with respect to the supply voltage.

As a specific example, for a thermodynamic voltage Vt of 26 mV at 25° C. and for a resistance $R_{pol}$ of 6.6 k Ω, a current $I_{ou}$t of approximately 113.8 μA is obtained for a voltage Vcc of 10 V. For a 10% variation of supply voltage Vcc, a variation of the output current of approximately 0.4% is obtained.

FIG. 2 shows an example of conventional diagram of a so-called "crossed" or "ΔVbe/R" bias source. Such a ΔVbe/R source includes, between supply lines Vcc and Vee, a first branch provided with, in series, a resistor R, a PNP transistor T3, a diode-connected NPN transistor T4, and an NPN transistor T5, and a second branch provided with, in series, a resistor R, a diode-connected PNP transistor T6, two NPN transistors T7 and T8 and a resistor $R_{pol}$. It is assumed in this example that the output current $I_{out}$ corresponding to the collector current of transistor T6 is a current "entering" into the bias source. The bases of transistors T3 and T6 are connected to the collector of transistor T6. The bases of transistors T4 and T7 are connected to the collector of transistor T4. The emitter of transistor T7 is connected to the base of transistor T5 and to the collector of transistor T8. The emitter of transistor T4 is connected to the base of transistor T8 and to the collector of transistor T5. Resistors R are optional.

As previously, one or several transistors (Q', FIG. 1) are connected as current mirrors on transistor T6 to bias the different sub-assemblies of the circuit.

The operation of such a ΔVbe/R bias source is perfectly well known. The value of current $I_{out}$ is given, neglecting the base currents, by the following relation:

$$Iout = \frac{Vt}{R_{pol}} \cdot \mathrm{Ln}\left[\frac{S3 \cdot S4}{S6 \cdot S7} \cdot \frac{1}{\left(1 + \frac{Vce_6}{V_{AFNPN}}\right)}\right],$$

where S3, S4, S6, S7 represent the respective emitter surfaces of transistors T3, T4, T6, and T7, $Vce_6$ represents the collector-emitter voltage of transistor T6, and $V_{AFNPN}$ designates the Early voltage of transistor T6 and reflects the output impedance of this bipolar transistor.

In this formula, the only term which is variable according to supply voltage Vcc is the collector-emitter voltage of transistor T6. Indeed, this voltage can be expressed as Vcc−2Vbe. Accordingly, when the supply voltage increases, voltage $Vce_6$ increases and output current $I_{out}$ decreases, since ratio $Vce_6/V_{AFNPN}$ is not negligible with respect to 1.

In a ΔVbe/R bias source, a variation of supply voltage Vcc of approximately 10% results in a variation of the output current of approximately 0.6%. It should however be noted that the output current variation is inverted with respect to a Vbe/R bias source. Indeed, the variation of the biasing current with respect to the nominal value for which the bias source is sized is negative for an increase of supply voltage Vcc with respect to its nominal value. In a Vbe/R bias source, this variation is positive.

Another distinction between the Vbe/R and ΔVbe/R bias sources is the sign of their respective temperature variation coefficient. In a Vbe/R source, the temperature variation coefficient is negative, that is, the biasing current decreases with a temperature increase, whereas this coefficient is positive for a ΔVbe/R source. The respective temperature variation coefficients of the Vbe/R and ΔVbe/R sources are generally on the order of 1.5+10−3/° C. and $+1.5\times10^{-3}$/° C., respectively.

A ΔVbe/R source has, compared with a Vbe/R source, several disadvantages. First, it requires many more components. Further, it requires a circuit 2 (FIG. 2) for starting this bias source which effectively exhibits two steady states. Such a starting system is formed either of a resistor of high value, or of a field-effect transistor which has the disadvantage of causing a permanent power consumption, or of a still more complex electronic system.

SUMMARY OF THE INVENTION

An object of the present invention is to provide a novel bias source in which the independence of the output current with respect to the supply voltage is improved or optimized.

Another object of the present invention is to provide a bias source of simple structure which, in particular, does not require any starting system and which, further, does not alter the temperature variation coefficient with respect to conventional sources.

A characteristic of the present invention is to associate, with a Vbe/R bias source, a means for generating an error current to compensate, on the output branch of this source, the current flowing in its reference branch.

More specifically, the present invention provides a Vbe/R bias source of the type including a first reference branch and a second output branch, the bias source including means of correction of an output current by an error current proportional to the current flowing in the reference branch.

According to an embodiment of the present invention, the correction means is formed of a current mirror including a transistor that measures the reference current and a transistor that generates the error current.

According to an embodiment of the present invention, the error current is mixed with a collector current of an output transistor of the bias source.

According to an embodiment of the present invention, the bias source includes:

- a Vbe/R assembly, the first reference branch of which includes a resistor connected in series with a first transistor and the second output branch of which includes a transistor connected in series with a resistor for setting the output current; and
- an error current generation assembly having a measurement transistor interposed between the resistor of the reference branch and a first supply line, and having a transistor that generates the second error current connected as a current mirror on the measurement transistor, the collector of the generation transistor being connected to the collector of the second transistor of the Vbe/R assembly.

According to an embodiment of the present invention, a resistor is interposed between the emitter of the transistor that generates the error current and the first supply line.

According to an embodiment of the present invention, the transistors of the Vbe/R assembly are of type NPN and the transistors of the error current generation assembly are of type PNP.

According to an embodiment of the present invention, the transistors of the Vbe/R assembly are of type PNP the transistors of the assembly of generation of the error current being of type NPN.

According to an embodiment of the present invention, the bias source includes:

- a first Vbe/R assembly, a first reference branch of which includes a resistor setting a reference current and a first NPN transistor, and a second output branch of which includes a second NPN transistor and a first resistor for setting a first output current;
- a second Vbe/R assembly, a first reference branch of which includes a first PNP transistor and the resistor setting the reference current, and a second output branch of which includes a second PNP transistor and a second resistor for setting a second output current;
- a first generation assembly that generates an error current to correct the first output current; and
- a second generation assembly that generates a second error current to correct the second output current.

According to an embodiment of the present invention, each generation assembly that generates an error current, associated with a Vbe/R assembly, uses, as a reference current measurement transistor, the first transistor of the other Vbe/R assembly.

The foregoing objects, features and advantages of the present invention will be discussed in detail in the following non-limiting description of specific embodiments made in connection with the accompanying drawings.

DETAILED DESCRIPTION

For clarity, the same elements have been referred to with the same references in the different drawings.

According to the present invention, a Vbe/R assembly of conventional structure is used, and an assembly that controls a correction current of the output current with the value of the current flowing in the reference branch of the bias source is associated therewith.

Figure 3:
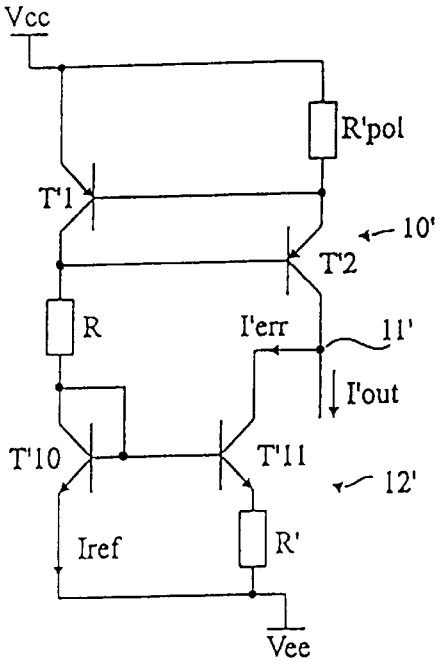
FIG. 3 shows a first embodiment of an entering current bias source according to the present invention.

FIG. 3 shows an embodiment of the present invention forming a bias source that can generate an output current $I_{out}$ to be reproduced to bring a corresponding (or proportional) current into sub-assemblies of an electronic circuit (not shown) to be supplied.

Figure 1:
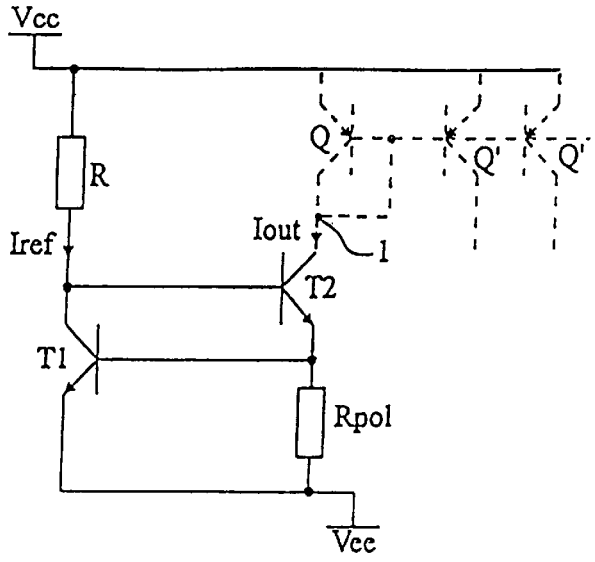
FIG. 1 (PRIOR ART)
FIGS. 1 and 2 which have been previously described, are meant to show the state of the art and the problem to solve.
Figure 2:
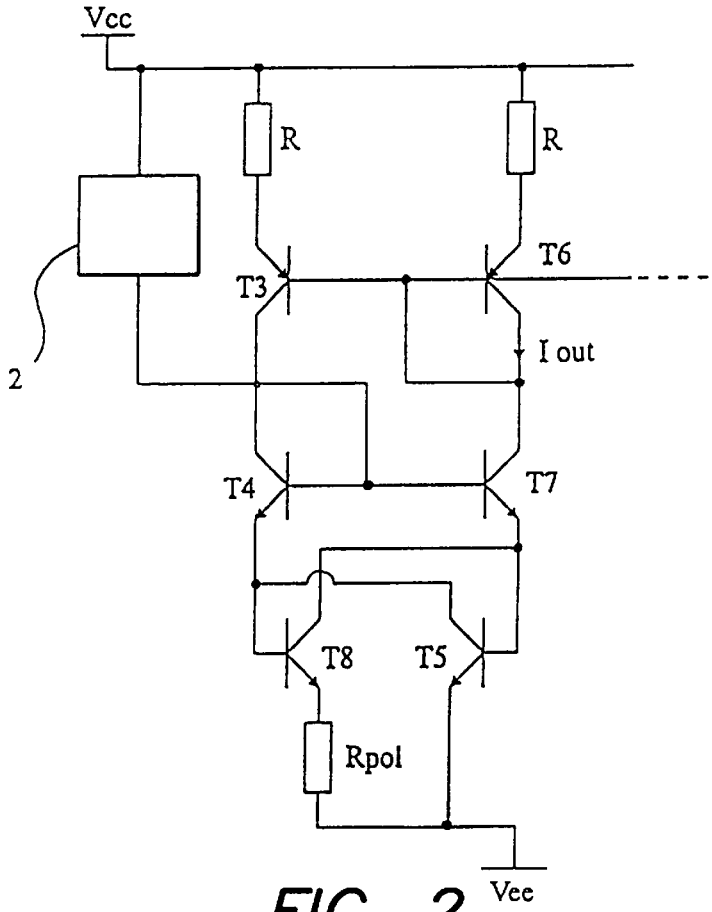
FIG. 2 (PRIOR ART)

According to this embodiment, a Vbe/R assembly 10 similar to the conventional source illustrated in FIG. 1 is used. Thus, assembly 10 is formed of a reference branch including a resistor R in series with an NPN transistor T1, the emitter of which is connected to the most negative supply line Vee (generally the ground), and of a second branch including an NPN transistor T2 in series with a resistor $R_{pol}$ for setting the desired biasing current. The base of transistor T1 is connected to the emitter of transistor T2, and the base of transistor T2 is connected to the collector of transistor T1. An output terminal 11 of the bias source is defined by the collector of transistor T2.

According to this embodiment, resistor R is connected to positive supply line Vcc via a diode-mounted PNP transistor T10, the emitter of which is connected to line Vcc. Transistor T10 is connected as a current mirror with a PNP transistor T11, the emitter of which is connected to line Vcc via a resistor R', and the collector of which is connected to output terminal 11 of the source. The assembly formed of transistors T10 and T11 and of resistor R' forms an assembly 12 generally referred to as a "Widlar source".

According to the present invention, reference current $I_{ref}$ flowing in the first branch of the bias source is copied by assembly 12 to generate an error current $I_{err}$ to correct the collector current of transistor T2. Accordingly, current $I_{out}$ corresponds to the collector current $Ic_2$ of transistor T2 minus error current $I_{err}$.

Among the equations governing the operation of the assembly of FIG. 3, one can write, neglecting the base currents of the transistors:

$$Ic_2 = \frac{Vt}{R_{pol}} \cdot \mathrm{Ln}\left(\frac{I_{ref}}{Is_1}\right); \text{ and}$$

$$I_{err} = \frac{Vt}{R'} \cdot \mathrm{Ln}\left(\frac{I_{ref}}{I_{err}}\right).$$

The value of current $I_{out}$ can then be written as:

$$I_{out} = \frac{Vt}{R_{pol}} \cdot \mathrm{Ln}\left(\frac{I_{ref}}{Is_1}\right) - \frac{Vt}{R'} \cdot \mathrm{Ln}\left(\frac{I_{ref}}{I_{err}}\right).$$

The variation of the output current with respect to the supply voltage follows from parameter $S_{V_{cc}}^{I_{out}}$ corresponding to the variation percentage of the output current divided by the variation percentage of the supply. This parameter can be expressed as follows:

$$S_{V_{cc}}^{I_{out}} = \frac{1}{I_{out}}\left[\frac{Vt}{R_{pol}} - \frac{I_{err}}{1 + \frac{I_{err} \cdot R'}{Vt}}\right] \cdot S_{V_{cc}}^{I_{ref}}.$$

As previously, parameter $S_{V_{cc}}^{I_{ref}}$ can, as a first approximation, be considered as equal to one if supply voltage Vcc is high enough with respect to the base-emitter voltages of the bipolar transistors ($I_{ref}$=(Vcc−3Vbe)/R). The variation percentage is thus reduced or minimized by the term including error current $I_{err}$.

As a specific example, for a voltage Vcc of 10 volts, and a resistance $R_{pol}$ of 6.6 k Ω, a current $I_{out}$ of approximately 100 μA and a current $I_{err}$ of approximately 13 μA are obtained, with Vt=26 mV at 25° C.

For a variation of voltage Vcc on the order of 10%, a variation of the output current on the order of 0.05% is then obtained. This variation should be compared with the 0.4 and 0.6% variations of known bias sources.

An advantage of the present invention is that it reduces or minimizes the influence of a variation of the supply voltage on the value of the output current.

Another advantage of the present invention is that the provided bias source keeps a simple structure, of low bulk. In particular, it requires no starting system as in a ΔVbe/R bias source.

It should be noted that, in a bias source according to the present invention, the temperature variation coefficient is of same sign as in a conventional Vbe/R bias source, that is, negative.

The temperature variation coefficient can be expressed as follows:

$$K = \frac{1}{Vbe_1} \cdot \frac{dVbe_1}{dT} - \frac{1}{R_{pol}} \cdot \frac{dR_{pol}}{dT},$$

where T represents the temperature in degrees Celsius.

Assuming that the bipolar transistors are implemented in a technology resulting in a value of Vbe of approximately 750 mV and in a value of dVbe/dT of approximately −2 mV/° C., and that resistor $R_{pol}$ is a polysilicon resistor obtained from a high resistivity layer having, for example, a sheet resistance of 1 k Ω, a coefficient K on the order of $1.5\times10^{-3}$/° C. for a conventional Vbe/R source and of $2.0\times10^{-3}$/° C. for a bias source according to the present invention such as shown in FIG. 3 is obtained. This difference is due to the fact that, for the same output current $I_{out}$, current $Ic_2$ has slightly different values between the two diagrams due to the subtraction of the error current in the assembly of the present invention.

Accordingly, the present invention maintains the temperature stability quality of a conventional Vbe/R bias source.

Figure 4:
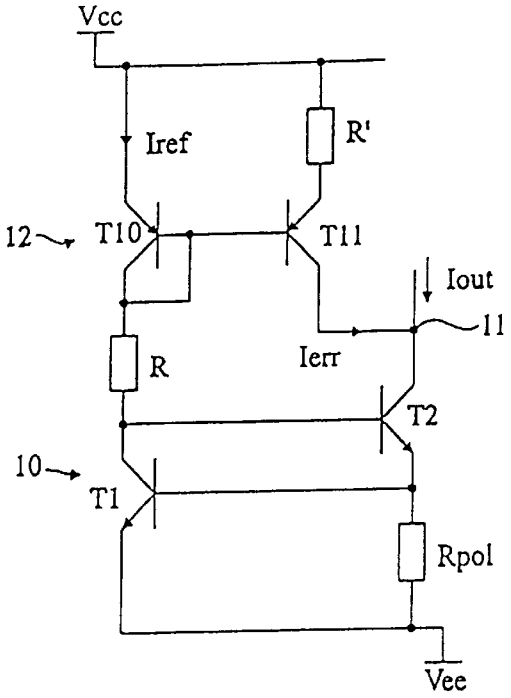
FIG. 4 shows an embodiment of an exiting current bias source according to the present invention.

FIG. 4 shows an embodiment of a bias source according to the present invention, meant to generate a current $I'_{out}$ adapted to being reproduced to take a corresponding (or proportional) current on sub-assemblies of the electronic circuit to be supplied.

The constitution of the assembly of FIG. 4 can be deduced from that described in relation with FIG. 3 by inverting the respective positions of Vbe/R bias source 10' and of Widlar assembly 12' with respect to supply lines Vcc and Vee, and by replacing PNP transistors T10, T11 with NPN transistors T'10, T'11, and NPN transistors T1, T2 with PNP transistors T'1, T'2. Output terminal 11' of the bias source shown in FIG. 4 is formed of the collector of transistor T'2, the emitter of which is connected to positive supply line Vcc via a resistor $R'_{pol}$. An error current $I'_{err}$ proportional to current $I_{ref}$ of the reference branch is taken from terminal 11'. Current $I'_{err}$ is, as in the embodiment of FIG. 3, proportional to current $I_{ref}$ flowing in the first branch of the bias source.

The operation of the assembly described in FIG. 4 can be deduced from that described in relation with FIG. 3.

Figure 5:
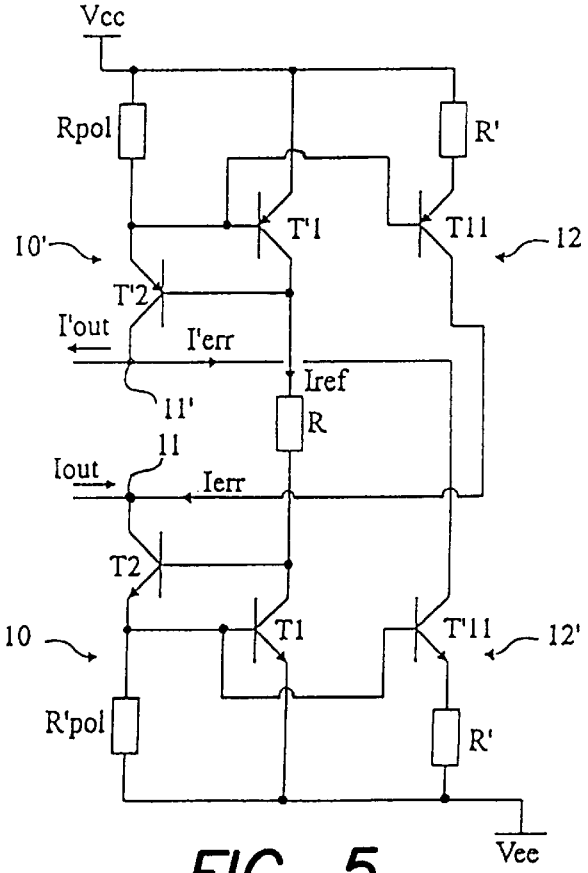
FIG. 5 shows an embodiment of a entering and exiting current bias source according to the present invention.

FIG. 5 shows an embodiment of a composite bias source according to the present invention, that is, adapted to setting entering and exiting output currents $I_{out}$ and $I'_{out}$.

To make such a bias source, two Vbe/R bias sources 10 and 10' respectively corresponding to the assemblies described in relation with FIGS. 3 and 4 are used according to the present invention. However, according to the embodiment shown in FIG. 5, a single resistor R setting reference current $I_{ref}$ is used. This resistor is placed between the collector of transistor T'1 of source 10' and the collector of transistor T1 of source 10.

An advantage of such a combination is that the implementation of a resistor is thus spared, which reduces or minimizes the surface occupied in the form of an integrated circuit.

Another characteristic of the embodiment illustrated by FIG. 5 is that Widlar assemblies 12 and 12' meant to respectively generate currents $I_{err}$ and $I'_{err}$ use, as transistors T10 (FIG. 3) and T'10 (FIG. 4) of measurement of current $I_{ref}$, transistors T'1 and T1. Thus, the base of transistor T'1, which is a PNP transistor, is connected to the base of PNP transistor T11 of assembly 12 meant to generate the error current $I_{err}$ of correction of current $I_{out}$. Similarly, the base of transistor T1, which is an NPN transistor, is connected to the base of transistor T'11 of assembly 12' meant to generate current $I'_{err}$ of correction of current $I'_{out}$.

It should be noted that transistors T1 and T'1 do not need to be diode-connected. Indeed, these transistors already conduct current $I_{ref}$ and their respective bases are biased via resistors $R'_{po1}$ and $R'_{pol}$.

The operation of the assembly of FIG. 5 can be deduced from the respective operations of the assemblies of FIGS. 3 and 4.

Of course, the present invention is likely to have various alterations, modifications, and improvements which will readily occur to those skilled in the art. In particular, the surfaces of the different bipolar transistors will be adapted according to the application and to the desired ratios between currents. Similarly, the sizings of the different resistors are within the abilities of those skilled in the art according to the desired current values and to the nominal supply voltage. Further, it will be provided to use, in particular for resistors R and $R_{pol}$ (FIGS. 3 and 5), R' and $R'_{po1}$ (FIGS. 4 and 5), resistors of the same type and to implant these resistors close to one another in an implementation in the form of an integrated circuit.

Such alterations, modifications, and improvements are intended to be part of this disclosure, and are intended to be within the spirit and the scope of the invention. Accordingly, the foregoing description is by way of example only and is not intended to be limiting. The invention is limited only as defined in the following claims and the equivalent thereto.

What is claimed is:

1. A Vbe/R bias source of the type including a first reference branch and a second output branch, and including means formed of a current mirror including a transistor that measures the reference current flowing in the reference branch and a transistor that generates an error current for correcting an output current by said error current proportional to the reference current and a function of a resistor interposed between the emitter of the transistor that generates the error current and a first supply line.

2. The bias source of claim 1, wherein the error current is mixed with a collector current of an output transistor of the bias source.

3. A Vbe/R bias source of the type including a first reference branch and a second output branch, and including;

means formed of a current mirror including a transistor that measures the reference current flowing in the reference branch and a transistor that generates an error current for correcting an output current by said error current proportional to the reference current and a function of a resistor interposed between the emitter of the transistor that generates the error current and a first supply line;

a Vbe/R assembly, the first reference branch of which includes a resistor connected in series with a first transistor and the second output branch of which includes a transistor connected in series with a resistor for setting the output current; and an error current generation assembly having, a measurement transistor interposed between the resistor of the reference branch and a first supply line, and having a transistor that generates the second error current connected as a current mirror on the measurement transistor, the collector of the generation transistor being connected to the collector of the second transistor of the Vbe/R assembly.

4. The bias source of claim 3, wherein the transistors of the Vbe/R assembly are of type NPN, the transistors of the error current generation assembly are of type PNP.

5. The bias source of claim 3, wherein the transistors of the Vbe/R assembly are of type PNP and the transistors of the error current generation assembly are of type NPN.

6. A Vbe/R bias source of the type including a first reference branch and a second output branch, and including:

means formed of a current mirror including a transistor that measures the reference current flowing in the reference branch and a transistor that generates an error current for correcting an output current by said error current proportional to the reference current and a function of a resistor interposed between the emitter of the transistor that generates the error current and a first supply line;

a first Vbe/R assembly, a first reference branch of which includes a resistor setting a reference current and a first NPN transistor, and a second output branch of which includes a second NPN transistor and a first resistor for setting a first output current;

a second Vbe/R assembly, a first reference branch of which includes a first PNP transistor and the resistor setting the reference current, and a second output branch of which includes a second PNP transistor and a second resistor for setting a second output current;

a first generation assembly that generates an error current to correct the first output current; and a second generation assembly that generates a second error current to correct the second output current.

7. The bias source of claim 6, wherein each generation assembly that generates an error current, associated with a Vbe/R assembly uses, as a reference current measurement transistor, the first transistor of the other Vbe/R assembly.

8. The bias source of claim 3, wherein the resistor setting the output current is a resistor integrated in high resistivity polysilicon.

* * * * *